United States Patent [19]

Gala

[11] Patent Number: 4,607,841

[45] Date of Patent: Aug. 26, 1986

[54] ISOMETRIC EXERCISE APPARATUS

[76] Inventor: Jeffrey A. Gala, 6904 Valley Spring Dr., Birmingham, Mich. 48010

[21] Appl. No.: 450,269

[22] Filed: Dec. 16, 1982

[51] Int. Cl.[4] ..... A63B 21/00

[52] U.S. Cl. ..... 272/125; 272/143; 272/DIG. 5; 73/379

[58] Field of Search ..... 272/125, 134, 143, DIG. 5; 73/379

[56] References Cited

U.S. PATENT DOCUMENTS

| | | | |
|---|---|---|---|
| 3,372,928 | 3/1968 | Showalter | 272/125 |
| 3,387,493 | 6/1968 | Strittmatter | 73/379 |
| 3,397,884 | 8/1968 | Blasi | 272/83 |
| 3,424,005 | 1/1969 | Brown | 73/379 |
| 3,807,728 | 4/1974 | Chillier | 272/134 |
| 3,896,672 | 7/1975 | Henson | 73/379 |
| 3,989,240 | 11/1976 | Victor | 272/125 |
| 4,184,678 | 1/1980 | Flavell | 272/129 |
| 4,241,914 | 12/1980 | Zwayer et al. | 272/134 |
| 4,261,562 | 4/1981 | Flavel | 272/129 |
| 4,326,707 | 4/1982 | Strecker | 272/130 |
| 4,354,676 | 10/1982 | Ariel | 272/134 |
| 4,408,759 | 10/1983 | Reneau et al. | 272/134 |

*Primary Examiner*—Richard C. Pinkham
*Assistant Examiner*—Leo P. Picard
*Attorney, Agent, or Firm*—Basile, Weintraub & Hanlon

[57] ABSTRACT

An exercise apparatus includes a stand having an upright support and a base. User engagable members are mounted on the upright support for the user to exert a force thereagainst. A scale is mounted on the base of the stand to support the user and to measure the force exerted by the user against the user engageable members. A display is connected to the scale to provide a visual indication of the force measured by the scale. In one embodiment, the user engagable members are movable vertically along the stand in a controlled manner at preselected speeds, direction and length of travel. The user engagable members are also movable in a controlled manner transversely with respect to the stand at predetermined speeds, directions and lengths of travel. A pair of scales are alternately mounted on a trolley which is movable vertically along the stand to measure the upward and downward forced exerted by the user on the user engagable members.

11 Claims, 12 Drawing Figures

ISOMETRIC EXERCISE APPARATUS

BACKGROUND OF THE INVENTION

1. Field of the Invention

This invention relates, in general, to exercising apparatus and, more specifically, to isometric and isokinetic exercising apparatus.

2. Description of the Prior Art

A large number of exercises, some employing exercising apparatus, have been devised to tone and build muscle tissue in the human body. A popular type of exercise is an isometric exercise in which one muscle group is tensed and placed in opposition to another muscle group or a solid surface. This type of exercise is effective in toning and building muscle tissue and enables a muscle to be exercised to its maximum fatigue point without exposing the exerciser to the danger of the falling weights commonly used in arm and shoulder lifting exercises which could fall and injure the user should the user fail to complete the last repetition or lifting cycle.

Exercising apparatus have also been devised which incorporate power driven exercise components, such as cables and straps, which drive selected muscles through a preselected motion pattern at a predetermined speed. Such devices, when used for isometric exercises, are brought to a stop so that the selected muscle can be tensed for a predetermined amount of time. Although effective at strengthening muscle tissue, such isometric exercise apparatus fail to exercise the full muscle length. Thus, it would be desirable to provide an exercise apparatus which over comes the problems of previously devised exercise apparatus suited for performing isometric exercises. It would also be desirable to provide an exercise apparatus which is suitable for performing isometric exercises in which the entire muscle length is exercised in full extension and flexion. It would also be desirable to provide an exercise apparatus which can be programmed to isokinetically exercise a muscle through a variety of speeds, directions and lengths of movement.

Another important factor in achieving maximum muscle tissue strength and toning is to exercise each muscle to its maximum capacity. This is easy to accomplish in weight lifting types of exercises since the weights can be repeatedly lifted until the muscle fatigue level is reached. However, in isometric exercises, the user cannot be sure that he is exerting maximum force. In order to overcome this problem, isometric exercising apparatus have been devised which incorporate some type of force indicator or scale to provide an indication of the force exerted by the user during the exercise. Such force measuring devices typically employ scales which are responsive to movement of a bar or member against which the user exerts a force during the exercise. The scales must be calibrated to convert incremental movement of the bar or member into pounds of force. Due to calibration errors and the complexity of the mechanical components required, such force measurement devices at best provide an indirect and rough estimate of the force actually exerted by the user during the isometric exercise.

Thus, it would be desirable to provide an exercise apparatus which overcomes the problems of previously devised exercise apparatus in measuring and providing an indication of the force exerted by a user during an isometric exercise. Finally, it would be desirable to provide an isometric and isokinetic exercise apparatus which directly measures and displays the amount of force exerted by the user during the exercise.

SUMMARY OF THE INVENTION

There is disclosed herein a unique exercise apparatus which is suited for performing both isometric and isokinetic exercises. The exercise apparatus includes a stand having an upright support and a base. User engagable means are mounted on the upright support for the user to exert a force thereagainst. Scale means are mounted on the base of the stand to support the user and to measure the force exerted by the user against the user engagable means. A display is connected to the scale to provide a visible indication of the force measured by the scale.

The scale provides a direct measurement of the force exerted by the user against the user engagable means since the user's weight as measured by the scale will increase or decrease by the amount of such exerted force depending upon the direction of force exerted by the user on the user engagable means.

In one embodiment, the user engagable means are vertically movable along the stand in a controlled manner at preselected speeds, directions of movement and lengths of travel. A rotatable screw is mounted within the stand and is driven by a preprogrammed logic controller at predetermined speeds, directions, time and number of repetitions or cycles. A trolly carrying the user engagable means threadingly engages the screw and is driven vertically along the stand to exercise the entire length of selected muscles of the user.

In another embodiment, the user engagable means are threadingly attached to horizontally positioned rotatable screws which are driven at preselected speeds, directions and time periods by the logic controller for further exercise of preselected muscles.

Alternately, a pair of load cells or scales are mounted on the trolley and are responsive to up and down movements of the user engagable means to provide a measurement of the force exerted in either direction by the user.

Further, omni-directional, movable user engagable means may be coupled with a load cell to provide a measurement of the force exerted by the user in any direction.

The unique exercise apparatus of the present invention overcomes many of the problems associated with previously devised exercise apparatus and, in particular, exercise apparatus particularly suited for isometric and isokinetic exercises. The exercise apparatus of the present invention provides a direct measurement and display of the force actually exerted by the user during the exercise. In addition, by driving the user engagable means vertically along the stand and, optionally, transversely with respect to the stand at preselected speeds, directions and time periods, the entire muscle length of preselected muscles can be exercised during the isokinetic exercise. Finally, by utilizing a programmable logic controller for driving the user engagable means vertically and/or transversely, various exercising routines, such as warmup, therapeutic, etc., can be preprogrammed for added versatility, which mimic all types of muscle action, such as flexion, extension, adduction and abduction.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figures 1, 2, 5, 6:
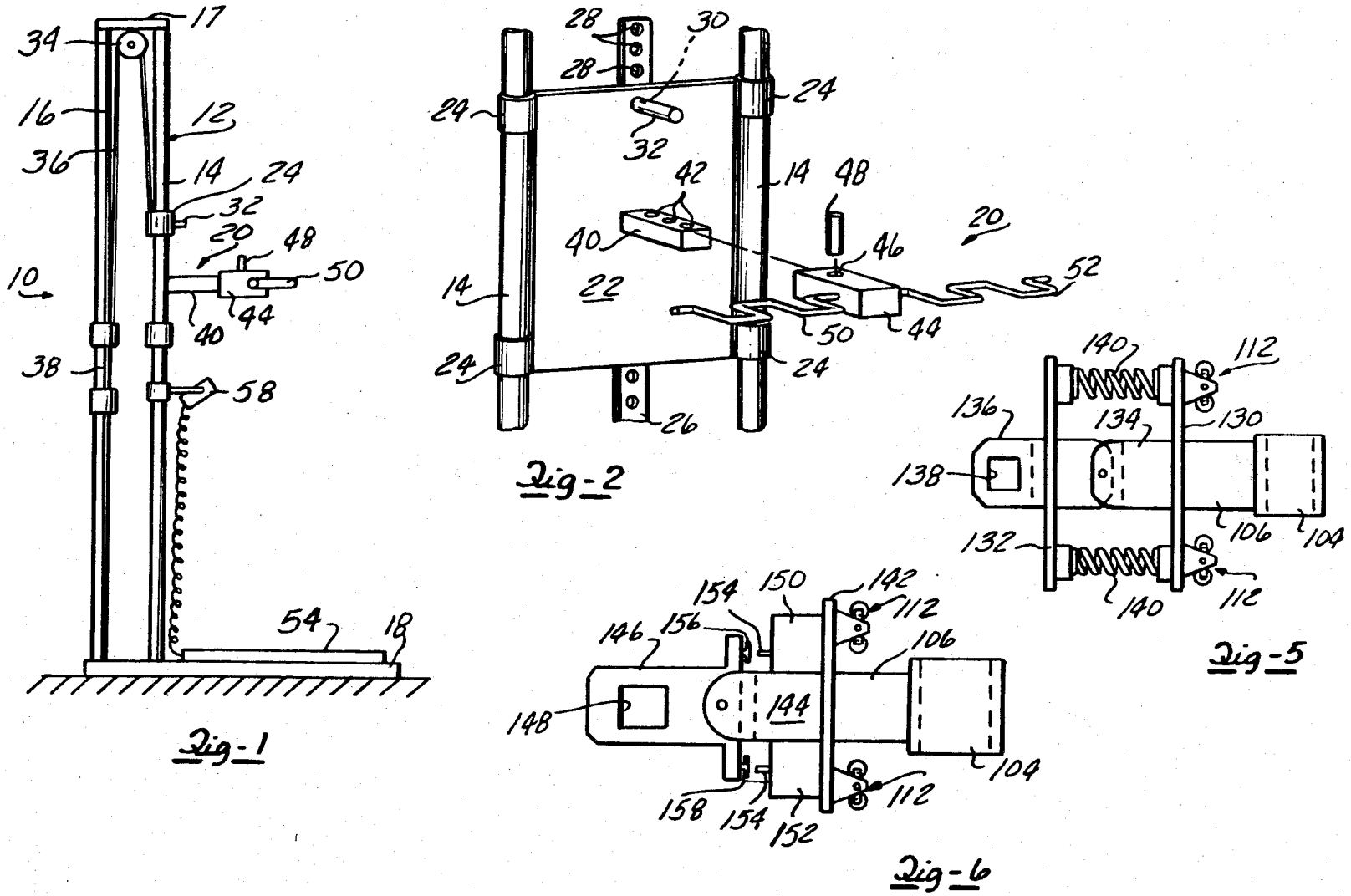
FIG. 1 is a side elevational view of one embodiment of an exercise apparatus constructed in accordance with the teachings of the present invention.
FIG. 2 is an enlarged, partial, perspective view depicting the mounting of the user engagable means on the stand illustrated in FIG. 1.
FIG. 5 is an elevational view of one embodiment of the means for mounting the user engagable means on the stand.
FIG. 6 is an elevational view of another embodiment of the means for mounting the user engagable means on the stand including an alternate scale means.

Throughout the following description and drawing, the same reference number is used to identify the same component shown in multiple figures of the drawing.

Referring now to the drawing, there is illustrated various views of an exercise apparatus which is suitable for performing isometric and/or isokinetic exercises. The exercise apparatus includes a stand having user engagable means mounted thereon for the user to exert a force thereagainst. Scale means are mounted on the base of the stand to support the user and measure the force actually exerted by the user against the user engagable means. A display provides a visible indication of the measured force.

Referring now to FIGS. 1 and 2, there is illustrated one embodiment of an exercise apparatus 10 constructed in accordance with the teachings of the present invention. The exercise apparatus 10 includes a stand 12 having an upright support formed by a plurality of spaced, vertically extending posts 14 and 16 which are arranged in aligned pairs. A top plate member 17 is connected to the upper ends of the posts 14 and 16. The bottom end of the posts 14 and 16 are mounted and secured to a base 18.

The exercise apparatus 10 further includes user engagable means, generally denoted by reference number 20, which are mounted on the upright support of the stand 12. Although the user engagable means 20 is illustrated and referred to hereafter as comprising at least one and, preferably, a pair of hand grips which are grasped by the user during an exercise, it will be understood that the user engagable means 20 may also comprise any type of support which the user can exert a force against. For example, the user engagable means 20 may comprise a foot support.

A trolley 22, shown in FIG. 2, is movably mounted on the posts 14. The trolley 22 has a planar, plate-like configuration and is slidingly mounted to the support posts 14 by means of a plurality of hollow collars 24 which are slidingly disposed about the posts 14 and connected to the edges of the trolley 22.

An elongated, vertically extending bar or strap 26 is mounted between the posts 14 and is secured at opposed ends to the top plate member 17 and the base 18 of the stand 12. A plurality of vertically spaced apertures 28 are formed in the bar 26. A mating aperture 30 is formed in the trolley 22. Connecting means, in the form of a pin 32, is removably engagable with the aperture 30 in the trolley 22 and one of the apertures 28 in the bar 26 for selectively securing the trolley 22 in one of a plurality of vertically spaced positions along the vertical extent of the posts 14 of the stand 12.

As shown in FIG. 1, a counterbalance means is provided to enable easy movement of the base 22 vertically along the stand 12. The counterbalance means includes a pulley 34 which is mounted adjacent the top of the posts 14 and 16 and which supports a chain or cable 36. The opposed ends of the cable 36 are secured to a counterbalance weight 38 slidingly mounted on the support posts 16 and to the trolley 22 mounted on the support posts 14.

Figure 3:
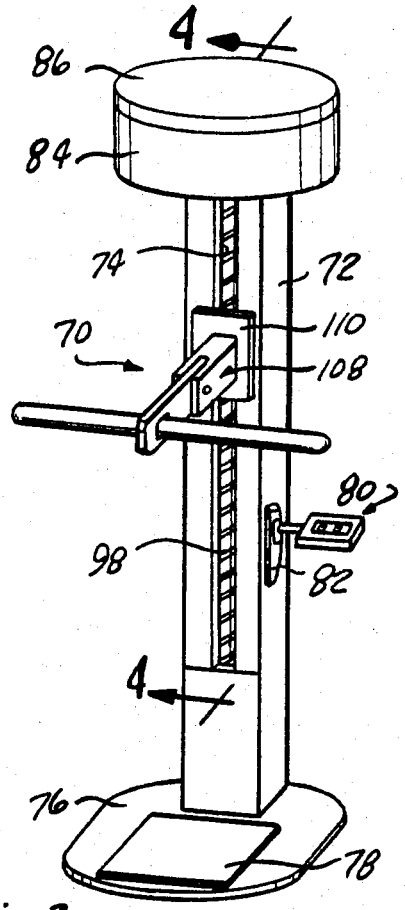
FIG. 3 is a perspective view of another embodiment of an exercise apparatus constructed in accordance with the teachings of the present invention.

Referring again to FIG. 2, the trolley 22 is provided with an outwardly extending boss 40 which has a plurality of spaced apertures 42 formed therein. The boss 40 telescopingly receives a correspondingly shaped sleeve 44 which has a single aperture 46 formed therein. A connecting pin 48 is engageable with the aperture 46 in the sleeve 44 and one of the apertures 42 in the boss 40 to mount the sleeve 44 in one of several positions along the boss 40. At least one and preferrably a pair of hand grips 50 and 52 are securely fixed to the sleeve 44 and provide a grip against which the user can exert a force during an isometric exercise. Although the hand grips 50 and 52 may simply comprise a straight bar, as shown in FIG. 3, it is preferred that the hand grips 50 and 52 have a back and forth square configuration to provide multiple grip positions.

Scale means 54 are mounted on the base 18 of the stand 12 as shown in FIG. 1. The scale means 54 may be any conventional weighing scale having an enlarged weighing platform which measures weight by means of the force which is disposed thereon.

A display means 58 is mounted on the stand 12 in a movable manner on one of the support posts, such as upright support post 14. The display means 58 may be any type of conventional display, such as LED display or a movable needle display. The display 58 is connected to the scale 54 and provides a visual display to the user of the exercise apparatus 10 of the force which he is actually exerting against the hand grips 50 and 52 as measured by the scale 54.

In operation, the user initially adjusts the height of the user engagable means 20 by moving and fixing the trolley 22 in the desired vertical position on the stand 12. The user then stands on the scale 54 and zeros the display 58 for his tare weight. In conducting the exercise, the user exerts force on the user engagable means 20 by pulling down or pushing up against the hand grips 50 and 52 as in a conventional isometric manner. The scale 54 measures the amount of force exerted by the user against the hand grips 50 and 52 and provides such force information to the display 58. As pushing up on the hand grips 50 an 52 will effectively increase the weight of the user on the scale 54, the scale 54 will thus provide a direct measurement of such increased force. Conversely, when the user is pulling down on the hand grips 50 and 52, his effective weight on the scale 54 decreases which is again directly measured by the scale 54 and displayed by the display 58.

Figure 4:
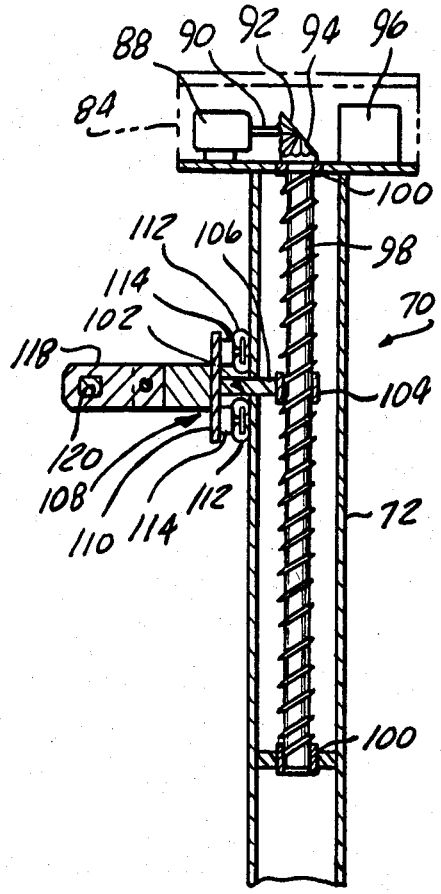
FIG. 4 is a cross sectional view generally taken along line 4—4 in FIG. 3.

Referring now to FIGS. 3 and 4, there is illustrated another embodiment of the exercise apparatus of the present invention in which the user engagable means 20 are moved along the stand 12 in a predetermined controlled manner. The exercising apparatus 70 illustrated in FIG. 3 includes a stand having an upright support 72 in the form of a tubular, hollow post. A vertically extending slot 74 is formed in one side of the post 72. The bottom end of the post 72 is mounted on an enlarged base 76 which supports a scale means 78 having an enlarged weighing platform. A display 80 is mounted on the side of the post 72 in a movable manner, such as by a Velcro strip 82 which mates with a corresponding Velcro member attached to an arm fixed to the display 80.

An enclosure 84 is mounted on the top end of the post 72 and is closed by a removable cover 86. A motor means 88, such as a reversible, variable speed, electrical motor, is mounted within the enclosure 84, as shown in FIG. 4. The motor 88 has an output shaft 90 extending therefrom and a gear, such as a bevel gear 92, mounted at the end thereof. The gear 92 engages and drives a correspondingly formed gear 94, as will be described in greater detail hereafter.

A control means 96 is also mounted within the enclosure 84. Preferably, the control means 96 is in the form of a programmable logic controller, such as one sold commercially by the Allen-Bradley Co., Milwaukee, Wis. under the trade designation "PLC", which is preprogrammed to drive the motor 88 at a variety of preselected speeds, directions of output shaft rotation and number of cycles as determined by various user inputs, not shown.

As shown in FIG. 4, a vertically extending, rotatable screw 98 is mounted within the post 72. The screw 98 is provided with a plurality of external threads and is rotatably supported at opposed ends in bushings 100 mounted within the post 72. The gear 94 is mounted on the top end of the screw 98 and is engaged and driven by the gear 92 attached to the output shaft 90 of the motor 88 as described above. Thus, rotation of the motor 88 and output shaft 90 is transmitted through gears 92 and 94 to selective bi-directional rotation of the screw 98.

Means, denoted in general by reference number 102, are provided for threadingly connecting a hand grip means to the rotatable screw means 98. In the embodiment illustrated in FIG. 4, the connecting means 102 includes a collar 104, such as a conventional ball nut, which is provided with internal threads. The collar 104 is disposed about the screw 98 and is vertically movable up and down the screw 98 depending upon the direction of rotation of the screw 98. An elongated bar 106 is connected to the collar 104 and extends outward through the slot 74 exteriorly of the post 72.

Means 108 are provided for guiding the hand grip means vertically along the post 72. The guiding means 108 includes a trolley having a plate 110 which is connected to the bar 106. A plurality of wheels 112 are mounted to the plate 110 by means of mounting brackets 114 and axles, not shown. Preferably, the wheels 112 are in the form of rollers and are mounted in a plurality of spaced pairs on the plate 110 to engage the exterior surface of the support post 72 of the stand 70 so as to control or guide the movement of the hand grip means vertically along the support post 72.

An elongated boss 118 is connected to one side of the plate 110 and includes an aperture 120 which is adapted to receive a portion of the hand grips, as will be described in greater detail hereafter.

In operation, the user of the exercise apparatus 70, shown in FIGS. 3 and 4, initially programs the controller 96 for the desired speed, direction and length of travel of the hand grips and exercise program which includes the number of exercise cycles or repetitions. The controller 96 has been previously programmed to drive the motor 88 in the predetermined directions, speeds and distances, which are selected by user input exercise information and input to the controller 96 by means of pushbuttons mounted in a central control panel 97 shown, by way of example, in FIG. 12.

Figure 12:
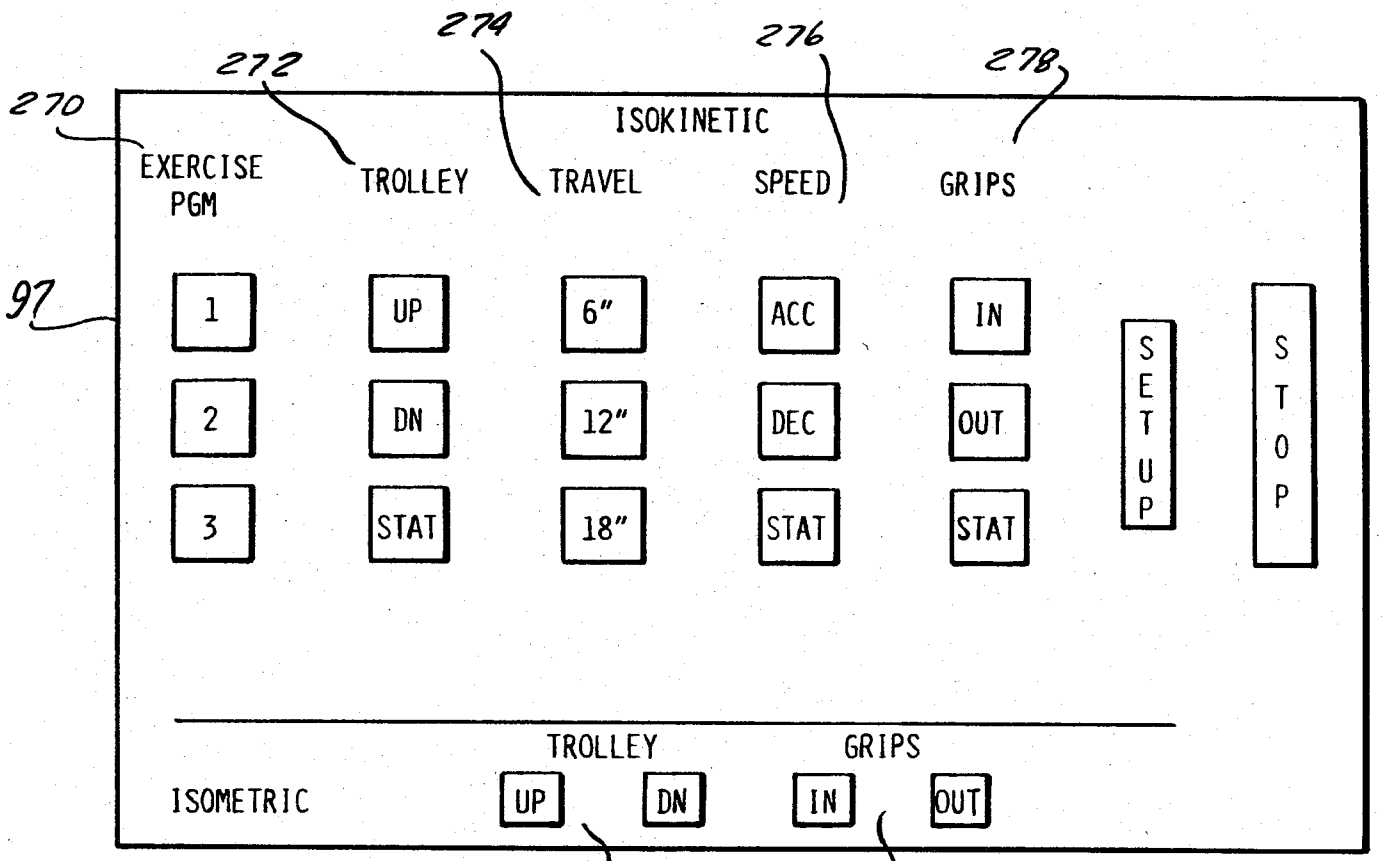
FIG. 12 is a pictorial view of a central control panel for selecting various operational movements of the exercise apparatus of the present invention.

As shown in FIG. 12, various pushbuttons are provided for selecting the desired lesson or exercise program 270, direction of trolley movement 272, distance of trolley travel 274, speed of movement of the trolley 276 and direction of hand grip movement 278 as described hereafter.

Pushbuttons 280 are also provided for adjusting the position of the trolley for isometric exercises. Also, pushbuttons 282 position the hand grips for isometric exercises.

After selecting the desired exercise, the user stands on the scale 78 and adjusts the display 80 to compensate for his tare weight. When energized, the controller 96 will drive the motor 88 to cause rotation of the screw 98 in the preselected direction so as to drive the hand grips vertically up and/or down the post 72 at the desired programmed or variable speeds and at the desired number of programmed repetitions or cycles. During such movement, the user exerts a force against the hand grips in conducting the isokinetic exercise such that the entire muscle length is exercised during the full preprogrammed movement of the hand grips, with a visual display of the exerted force being provided by the display means 80.

Referring now to FIG. 5, there is illustrated another embodiment of the means for attaching the hand grips to the threaded collar 104. In this embodiment, a spring action is provided for additional exercise of the selected muscle or muscle group.

As shown in FIG. 5, the trolley includes a pair of plates 130 and 132. The first plate 130 is connected to the bar 106 attached to the threaded collar or ball nut 104. The wheels 112 are mounted on one side of the plate 130 in the same manner as set forth in the embodiment depicted in FIG. 4. A fork member 134 having a slot formed at one end is connected to the opposite side of the first plate 130. The slot in the fork member 134 pivotally receives an arm 136 which extends through an aperture in the second plate 132. The arm 136 has an aperture 138 formed therein which receives the hand grips, as will be described in greater detail hereafter. Thus, movement of the arm 136 by means of force exerted on the hand grips by the user will cause pivotal movment of the plate 132. A plurality of compression springs 140 are mounted between the plates 130 and 132 to provide a force resistance to such pivotal movement which provides additional exercise of the selected muscles of the user.

In the embodiment shown in FIG. 6, a pair of load cells or scales 150 and 152 are mounted on a plate 142 attached to the trolley on opposite sides of a fork member 144. The fork member 144 has a slot formed at one end which pivotally receives an arm 146. The arm 146 has an interior slot 148 formed therein for securely receiving the hand grip assembly, as will be described in greater detail hereafter.

The first and second scales 150 and 152 mounted on the plate 142 each have a force responsive plunger 154 extending exteriorly therefrom. First and second actuators 156 and 158 are mounted on opposed ends of a flange formed at one end of the arm 146. The actuators 156 and 158 are preferably in the form of a threaded bolt having an enlarged head which may be threadingly extended or retracted with respect to the arm 146 to any desired length and locked in the desired position by means of a lock nut, not shown.

In use, force exerted on the hand grips will cause the arm 146 to pivot about the pivot connection between the arm 146 and the fork member 144. This will cause one of the actuators 156 and 158 to contact the plunger 154 on one of the scales 150 and 152 and register the up or down force, respectively, exerted by the user on the hand grips. As the scales 150 and 152 move concurrently with the threaded collar 104, a continuous force indication is visible to the user throughout the entire length of travel of the exercise apparatus.

Figure 7:
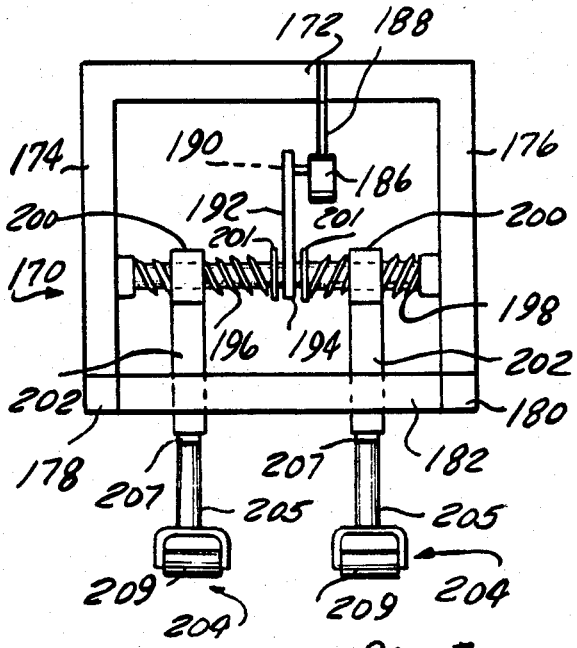
FIG. 7 is a plan view of one embodiment of the means for transversely moving the user engagable means.
Figure 8:
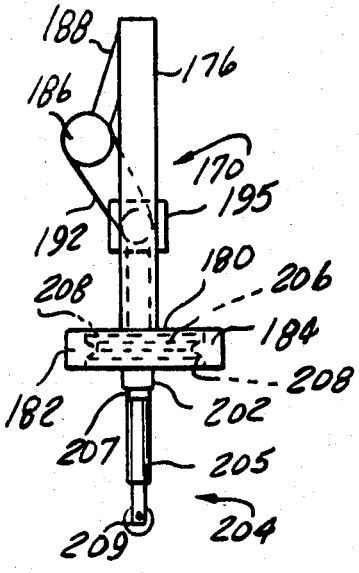
FIG. 8 is a right hand side view of the moving means illustrated in FIG. 7.

Referring now to FIGS. 7 and 8, there is illustrated one embodiment of a hand grip assembly which may be mounted on the arms 136 or 146, shown in FIGS. 5 and 6 of the trolley. As shown in FIGS. 7 and 8, a frame 170 is formed of first, second and third interconnected bars 172, 174 and 176, respectively. Bar 172 is adapted to be inserted, prior to its connection to the bars 174 and 176, through the aperture in the arm, such as aperture 148 in the arm 146, shown in FIG. 6, to attach the hand grips to the movable trolley.

A pair of vertically extending bars 178 and 180 are mounted at one end of the bars 174 and 176, respectively, and support in a spaced apart manner rails 182 and 184. Motor means 186, in the form of a reversible, variable speed, electrical motor, is mounted by means of a strap 188 to the bar 172. A chain or belt 192 is connected at one end to a sprocket or pulley 190 attached to the end of the output shaft of the motor 186. The other end of the chain 192 is connected to a second sprocket or pulley 194 mounted centrally between a pair of rotatable shafts 196 and 198. The rotatable shafts 196 and 198 are in the form of rotatable screws, which may be mounted or formed on a common shaft rotatably mounted between the bars 172 and 174. However, the screws 196 and 198 are formed with reversed threads. The sprocket 194 is mounted centrally between the rotatable screws 196 and 198 and transmits rotation of the output shaft of the motor 186 through the sprocket 190 and chain 192 to the screws 196 and 198.

A pair of threaded connectors 200 are movably mounted about the shafts 196 and 198 for transverse movement. Stop plates 201 are mounted on the shafts 196 and 198 to limit inward movement of the connectors 200. An elongated bar 202 is connected to each threaded connector 200 and extends through the spaced rails 182 and 184. Guide means are provided for controlling the movement of the hand grips 204 which are mounted at the end of the bars 202. Preferably, the guide means is in the form of rollers which roll between the spaced rails 182 and 184 as the threaded connectors 200 are driven by the rotatable screws 196 and 198. Preferably, the guide means comprises a roller having a V-shaped internal groove which rides within a correspondingly formed V-shaped strip 208 mounted on the rails 182 and 184, as shown in FIG. 8. In this manner, the hand grips 204 are adapted for transverse movement with respect to the rails 182 and 184 either towards or away from each other.

The hand grips 204 each preferably comprise a shaft 205 rotatably connected by a bearing 207 to the bars 202. A D-shaped grip 209 is fixedly secured to the shaft 205 for the user to grasp and exert a force thereagainst. Either pair of D-shaped grips 209 or shafts 205 may be grasped by the user so as to uniquely enable both pronation and supination types of muscle development.

It should also be noted that the motor 186 is connected to the controller 96 so as to be operated at preselected speeds, directions of output rotation and number and duration of programmed cycles.

Figure 9:
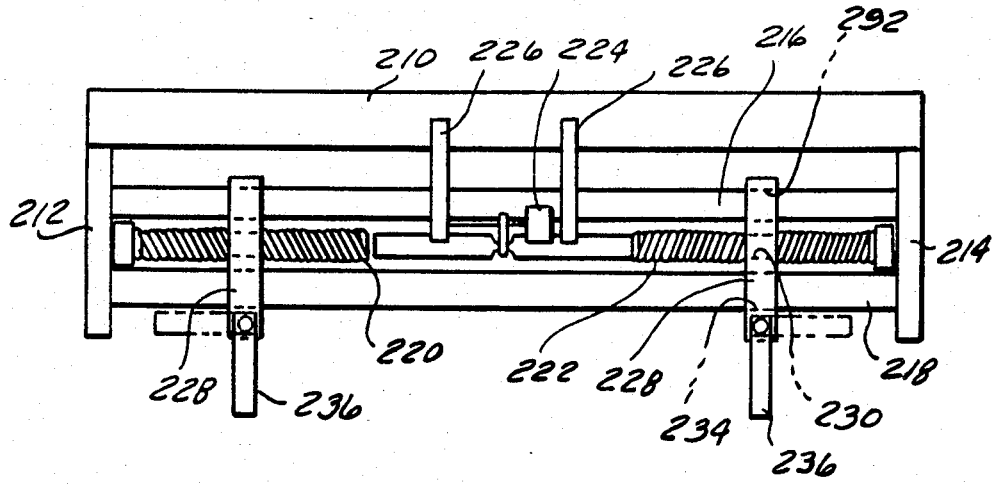
FIG. 9 is a plan view of another embodiment of the means for transversely moving the user engagable means.

Referring now to FIG. 9, there is illustrated another embodiment of the means for moving the hand grips transversely with respect to the stand 72. In this embodiment, a frame is provided which is comprised of interconnected bars 210, 212 and 214. The bar 210 is adapted to be inserted through the aperture in the arm, such as aperture 148 in arm 146 shown in FIG. 6, to connect the hand grips to the trolley. Two transversely extending shafts 216 and 218 extend between the side bars 212 and 214 of the frame.

Rotatable, reverse threaded, screws 220 and 222, mounted on a common shaft, also extend between the side bars 212 and 214 centrally between the spaced shafts 216 and 218. A motor 224 is mounted on spaced brackets 226 connected to the bar 210. The output shaft of the motor 224 drives a sprocket which is connected via a chain to a corresponding sprocket mounted centrally between the rotatable shafts 220 and 222.

An internally threaded bore 230 is formed in each of two connectors 228 and threadingly engages the rotatable screws 220 and 222 for driving the connectors 228 transversely with respect to the frame. Two apertures 232 and 234 are also formed in each connector 228 and slidingly engage the shafts 216 and 218 for controlling the movement of the connectors 228 and hand grips 236 mounted thereon transversely along the screws 220 and 222. Alternately, the shafts 216 and 218, as well as the apertures 232 and 234, could be formed in a splined configuration.

Any type of hand grip, such as the hand grips 204 shown in FIG. 7, may be used in the embodiment of the invention depicted in FIG. 9. However, another embodiment of the hand grips is illustrated in FIG. 9 by way of example. The hand grips 236 comprises a bar or rod having a soft outer covering. Each grip 236 is pivotally attached to an end of a connector 228 and is movable from a first position shown in solid to a second position depicted in phantom. In this manner, two grip positions may be selected for more complete muscle exercise.

Figure 10:
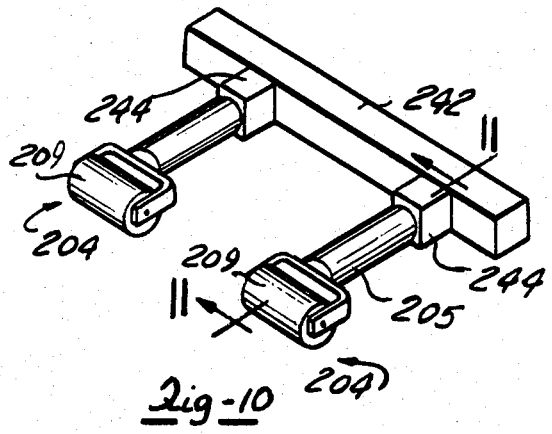
FIG. 10 is a perspective view of another embodiment of the means for mounting the user engagable means on the stand.
Figure 11:
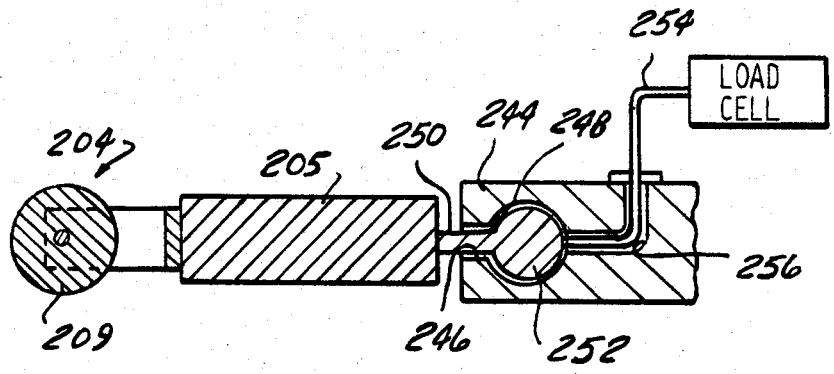
FIG. 11 is a cross sectional view generally taken along line 11—11 in FIG. 10.

Another means for connecting the hand grips in a movable manner on the stand 72 is illustrated in FIGS. 10 and 11. In this embodiment, the bars 205 which carry the grips 204 are rotatably mounted in bosses 244. The bosses 244 are connected to a bar 242 which is adapted to be inserted through the aperture in the arm, such as the aperture 148 in the arm 146, shown in FIG. 6.

As shown in FIG. 11, each boss 244 is formed with an internal cavity having a narrow throat portion 246 and an enlarged, substantially spherically-shaped interior portion 248. Each bar 205 is formed with a correspondingly formed projection having a narrow first portion 250 and an enlarged ball portion 252 which is disposed within the spherical cavity 248 within each boss 244.

An elongated, force transmitting cable 254 is disposed within a bore 256 formed in each boss 244 and is connected at one end to the ball portion 252 of each hand grip 240 and at a second end to a scale or load cell. In this manner, movement of each hand grip 204 in any direction will cause a corresponding movement of the force transmitting cable 254 attached to the ball portion 252 of each hand grip 204 which will be detected by the scale or load cell and cause a direct indication of the amount of force exerted by the user on each individual hand grip.

Thus, there has been disclosed a unique exercise apparatus which is particularly suited for performing isometric and/or isokinetic exercises. The apparatus includes a scale which supports the user and measures the amount of force exerted by the user against a user engagable means. Further, the user engagable means are movably mounted on the stand of the exercising apparatus and are moved in a controlled manner at varying preselected and programmed speeds, directions of travel and lengths of travel, as well as number of repetitions or complete exercising cycles. Also, the individual user engagable members which are movably mounted on the stand are also movable in a controlled manner transversely with respect to the stand during movement of the trolley vertically along the stand or when the trolley is stationarily positioned on the stand. In this manner, complete exercise of an entire muscle length is achieved during an exercise and a direct reading of the actual amount of force exerted by the user against the user engagable means is measured by the scale and displayed by a display means mounted on the exercising apparatus.

What is claimed is:

1. An exercise apparatus comprising:

a stand, the stand having an upright support and a base;

first and second user engagable members mounted on the upright support for a user to exert a force thereagainst;

a trolley movably mounted on the upright support of the stand for vertical movement, the user engagable means being mounted on the trolley;

drive means mounted on the stand for bi-directionally driving the trolley, the drive means including:

first bi-directional motor means;

a rotatable screw mounted within the upright support of the stand and drivenly connected to the motor means;

means for threadingly connecting the trolley to the rotatable screw; and control means for controlling the speed, direction and duration of rotation of the screw;

scale means mounted on the base of the stand for supporting a user and measuring the force exerted by the user against the user engagable means; and display means, connected to the scale means, for displaying the force measured by the scale means;

moving means connected to the first and second user engagable members for moving the first and second user engagable members transversely with respect to the stand, the moving means including:

a second motor means;

a pair of second screw means driven by the second motor means; and means for threadingly connecting each of the first and second user engagable members to the pair of second screw means, respectively, such that the first and second user engagable members move transversely with respect to the stand upon rotation of the pair of second screw means.

2. The exercise apparatus of claim 1 wherein the moving means includes means for guiding the movement of the user engagable member.

3. The exercise apparatus of claim 2 wherein the guiding means comprises:

first and second spaced rails disposed on opposite sides of the first and second user engagable members;

roller means rollable between the first and second rail; and the first and second user engagable members being connected to and movable with the roller means.

4. An exercise apparatus comprising:

a stand, the stand having an upright support and a base;

first and second user engagable members for a user to exert a force thereagainst;

a trolley movably mounted on the upright support of the stand, the first and second user engagable members being mounted on the trolley;

a rotatable screw mounted in the upright support of the stand;

drive means, mounted on the stand, for rotating the screw at a preselected speed, direction and duration of rotataion;

means for threadingly connecting the trolley to the screw for vertical movement as the screw rotates;

means for moving the first and second user engagable members in a controlled manner transversely with respect to the stand; the moving means including:

motor means;

a pair of rotatable second screw means mounted on the trolley and driven by the motor means; and means for threadingly connecting each of the first and second user engagable members to the pair of second screw means, respectively, such that the first and second user engagable members move transversely with respect to the stand upon rotation of the pair of second screw means;

scale means mounted on the base of the stand for supporting a user and measuring the force exerted by the user against the first and second user engagable members; and display means, connected to the scale means, for displaying the force measured by the scale means.

5. The exercise apparatus of claim 4 wherein:

the scale means includes first and second scales mounted on the trolley, the first scale being responsive to upward movement of the user engagable means, the second scale being responsive to downward movement of the user engagable means; and first and second display means, responsive to the first and second scales, respectively, for displaying the force measured by the first and second scales, respectively.

6. The exercise apparatus of claim 5 further including:

a connector pivotally attached to the trolley;

the user engagable means being mounted on the connector;

the first and second scale means each having force responsive plungers movably extending outward therefrom; and first and second actuators carried by the connector for engaging the plungers of the first and second scale means upon upward and downward movement of the user engagable means, respectively.

7. The exercise apparatus of claim 4 further including:

a plate secured to the trolley;

wheel means mounted on the plate and movably engaging the upright support of the stand for guiding the movement of the plate along the upright support of the stand.

8. The exercise apparatus of claim 4 wherein the user engagable means comprises:

omni-directional force transmitting means connected to the user engagable means and movably mounted on the trolley for omni-directionally transmitting the force exerted by the user on the user engagable means to the scale means.

9. The exercise apparatus of claim 4 wherein the moving means includes means for guiding movement of the one user engagable member.

10. The exercise apparatus of claim 9 wherein the guiding means comprises:

first and second spaced rails disposed on opposite sides of the user engagable member;

roller means rollable between the first and second rail; and the user engagable member being connected to the roller means.

11. The exercise apparatus of claim 9 wherein the guiding means comprises:

at least one shaft mounted on the trolley, the user engagable member slidably engaging the shaft while being moved by the moving means.

* * * * *